US006106393A

United States Patent [19]

Sunaga et al.

[11] Patent Number: 6,106,393

[45] Date of Patent: Aug. 22, 2000

[54] GAME MACHINE

[75] Inventors: Isao Sunaga; Hiroyuki Danjo; Yukinori Inamura, all of Tokyo, Japan

[73] Assignee: Universal Sales Co., Ltd., Tokyo, Japan

[21] Appl. No.: 08/919,016

[22] Filed: Aug. 27, 1997

[51] Int. Cl.[7] ..... G07F 17/34

[52] U.S. Cl. ..... 463/20; 463/16; 273/138.2

[58] Field of Search ..... 463/16, 20, 21, 463/22; 273/143 R, 138.2

[56] References Cited

U.S. PATENT DOCUMENTS

| | | | |
|---|---|---|---|
| 4,573,681 | 3/1986 | Okada | 273/143 R |
| 4,618,150 | 10/1986 | Kimura | 273/143 |
| 4,718,672 | 1/1988 | Okada | 273/143 |
| 4,926,327 | 5/1990 | Sidley | 273/138.1 |
| 4,993,713 | 2/1991 | Harada | 273/138 |
| 5,010,995 | 4/1991 | Okada | 194/219 |
| 5,018,737 | 5/1991 | Okada | 273/143 R |
| 5,024,439 | 6/1991 | Okada | 273/143 R |
| 5,074,559 | 12/1991 | Okada | 273/143 R |
| 5,083,785 | 1/1992 | Okada | 273/143 R |
| 5,127,651 | 7/1992 | Okada | 273/143 |
| 5,380,008 | 1/1995 | Mathis et al. | 273/143 R |
| 5,609,524 | 3/1997 | Inoue | 273/143 R |
| 5,667,219 | 9/1997 | Ishibashi | 273/143 R |
| 5,695,188 | 12/1997 | Ishibashi | 273/143 |
| 5,702,302 | 12/1997 | Gauselmann | 463/20 |
| 5,785,595 | 7/1998 | Gauselman | 463/20 |
| 5,826,882 | 10/1998 | Ward | 273/143 R |
| 5,873,781 | 2/1999 | Keane | 463/22 |
| 5,971,850 | 10/1999 | Liverance | 463/23 |
| 5,997,401 | 12/1999 | Crawford | 463/20 |

FOREIGN PATENT DOCUMENTS

| | | | |
|---|---|---|---|
| 0122138 A2 | 10/1984 | European Pat. Off. | G07F 17/34 |
| 0414427 A2 | 2/1991 | European Pat. Off. | G07F 17/34 |
| 0444932 A2 | 9/1991 | European Pat. Off. | G07F 17/34 |

*Primary Examiner*—Joe H. Cheng
*Assistant Examiner*—John M. Hotaling, II
*Attorney, Agent, or Firm*—Hutchins, Wheeler & Dittmar

[57] ABSTRACT

In a game machine, game result conditions may be randomly selected for a predetermined number of games among a plurality of given game result conditions and a demonstration may be made to provide a player of the game with a feeling of higher probability of winning a prize in the game when the randomly selected game result conditions include a given specific game result condition. The demonstration may be made by a variety of possible techniques, including using a flashing light or changing the volume or tone of a sound. Random numbers may be sampled in advance for random selection of game result conditions for the current game and for one or more games that will follow the current game, i.e., ranging several games down from the current game. These random numbers may be used to determine whether or not a demonstration should be made in the current game. As a result, more games will have demonstrations than in existing games, in which only the current games status can be considered, and more effective demonstrations may be made to enhance a player's interest in playing more games.

20 Claims, 10 Drawing Sheets

FIG. 10

90

| | RANDOM NUMBER 91 | RANDOM NUMBER 92 | RANDOM NUMBER 93 | RANDOM NUMBER 94 |
|---|---|---|---|---|
| FIRST RANDOM NUMBER | RANDOM NUMBER α1 | RANDOM NUMBER β1 | RANDOM NUMBER γ1 | RANDOM NUMBER δ1 |
| SECOND RANDOM NUMBER | RANDOM NUMBER α2 | RANDOM NUMBER β2 | RANDOM NUMBER γ2 | RANDOM NUMBER δ2 |

B

A

GAME MACHINE

FIELD OF THE INVENTION

The present invention relates to the field of game machines, and more particularly to the field of game machines such as slot machines in which unusual lighting, sounds, or any other similar indicator signals that a player may most likely win a prize.

BACKGROUND

Game machines such as slot machines that pay back tokens such as coins for winning game results are very popular. For slot machines, for example, players start a game by pulling a start lever after putting a token into the slot machine. A plurality (three, for example) of reels with numerous types of symbols arranged on the circumference rotate at high speed in the slot machine, and the prize status is determined by the combination of the symbols on the reels displayed at a given location in the window when the reels have stopped. The number of tokens that are paid out (i.e., the prize status) is determined by the combination of symbols when the reels have stopped. Slot machine prizes typically include "Big Jackpots," where a large number of tokens, such as 1000 or more tokens, for example, are paid back as a result when a bonus game has been awarded, as well as so-called "Little Jackpots" or "Small Jackpots". The player plays the slot machine in anticipation of increasing the number of tokens in the player's possession, but since the number of tokens in the player's possession does not increase all that much with "Small Jackpots," the player plays the slot machine while hoping for a "Big Jackpot" that will quickly increase the number of tokens in the player's possession.

The type of slot machine in which the prize status is determined by random selection using random numbers for each game is known. In this type of slot machine, the prize status is randomly selected when a token is put into the slot machine and the start lever is pulled, and the current game prize status is determined. When the current game prize status has been determined, the reels are rotated to begin the game. In most slot machines, the player can operate stop buttons provided in the slot machine to stop the reels, but in the type of slot machine in which the prize status is determined by random selection using random numbers for each game, the reels are not stopped immediately when the player actuates the stop buttons, but instead are stopped when the symbols on the reels reach the position corresponding to the prize status previously determined by random selection.

However, it is possible for too much time to pass after the player presses the stop buttons until the reels stop at the prize status that had been previously determined by random selection. This could lead to unnatural reel-stopping operations. In such cases, the reels may be stopped at a point that does not match the prize status previously determined by random selection. In other words, when too much time passes until the reels stop after the player has operated the stop bottons, leading to unnatural reel-stopping operations, the reels are stopped irrespective of the prize status previously determined by random selection. As a result, even when the prize status previously determined by random selection would have been, for example, a "Big Jackpot," the prize status may end up being a "Lose" due to the timing with which the player has actuated the stop buttons. Conversely, when the prize status previously determined by random selection would have been a "Lose," the prize status may end up being a "Big Jackpot" due to the circumstances under which the player actuated the stop buttons.

In the type of slot machines in which the prize status is determined by random selection using random numbers for each game, the prize status is randomly selected when the token has been put into the slot machine and the start lever has been pulled, so the current game prize status is already known when the reels begin to rotate. As described above, the player plays slot machines hoping for a "Big Jackpot" to quickly increase the number of tokens in the player's possession, and when it is known that there is an extremely high probability that the current game will result in a "Big Jackpot" as a result of previous random selection, it may be advantageous to alert the player to that fact. As described above, it is possible that the current game prize status might still end up as a "Lose" due to the timing with which the player actuates with the stop buttons.

SUMMARY OF THE INVENTION

An object of the present invention is to provide a game machine which can make more effective demonstrations when a "Big Jackpot" is most likely to be won based on random selection of the game prize status for the current game and for successive games. A game machine, described herein, for accomplishing this result may include random selection means for randomly selecting, at the beginning of the game, game result conditions for a predetermined number of games among a plurality of given game result conditions, storage means for storing the game result conditions selected for the predetermined number of games, actuating means for actuating the start of the game, determination means for determining whether or not the game result conditions randomly selected for the predetermined number of games include a given specific game result condition, and demonstration means for indicating a higher probability of winning a prize in the game when the randomly selected game result conditions include the given specific game result condition. Optionally, the plurality of given game result conditions may include a pseudo specific game result condition which is similar to the given specific game result condition and the demonstration means may function to make demonstration for the current game in case the pseudo specific game result condition is selected. Alternatively, a second random selection means also may be included for randomly selecting in advance several kinds of game result conditions for the current game at the beginning thereof, and selecting one of the several kinds of already selected game result conditions by a predetermined way to be a real game result condition for the current game, wherein the demonstration means may function to make demonstration for the current game in case the several kinds of randomly selected game result conditions include the given specific game result condition.

A game machine according to an embodiment of the present invention may include result selection means for randomly selecting game result conditions for a plurality of games, determining means for determining whether the results selected by the result selection means include at least one predetermined game result, and demonstration means, responsive to the determining means, for indicating a higher probability of winning a prize based on the results selected by the result selection means. The predetermined game result may be a condition in which each of the plurality of reels is aligned with each of the other reels. Alternatively, the result selection means may select a plurality of sets of randomly selected game results for the plurality of games, and then select one result from the plurality of sets of randomly selected game results as the result for the current game.

A game machine according to an embodiment of the present invention may include a main unit, an actuator coupled to the main unit, a result selector coupled to the main unit and having a random result selection component and a plurality of game result storage areas, a demonstrator coupled to the main unit, and an activator coupled to the demonstrator and responsive to the result selector, whereby the activator may activate the demonstrator when at least one of the game result storage areas contains a predetermined game result. The demonstrator may include at least one light or at least one speaker, or some combination or variation thereof.

A method of playing a game according to an embodiment of present invention may include randomly selecting game results for a plurality of games and demonstrating when the randomly selected game results include at least one predetermined game result. The randomly selected game result conditions may be stored before demonstrating. The game may be started either before or after storing the randomly selected game result conditions. Randomly selecting game results for a plurality of games may include selecting a plurality of sets of randomly selected game results and selecting a game result for the current game from the plurality of sets. The second selection may be made randomly. Demonstrating may include activating at least one light, or controlling at least one sound, or some combination thereof The game may be started by placing at least one token in at least one slot. Optionally, demonstrating may include indicating when the randomly selected game results include at least two predetermined game results, or some combination of predetermined game results.

BRIEF DESCRIPTION OF THE DRAWINGS

FIG. 10 is a schematic diagram illustrating structure of a random number store for the game machine of FIG. 9.

DETAILED DESCRIPTION OF THE PREFERRED EMBODIMENTS

In the type of slot machines in which the prize status is determined by random selection using random numbers for each game, the prize status is randomly selected when the token has been put into the slot machine and the start lever has been pulled, so the current game prize status is already known when the reels begin to rotate. The player plays slot machines hoping for a "Big Jackpot" to quickly increase the number of tokens in the player's possession, and when it is known that there is an extremely high possibility that the current game will result in a "Big Jackpot" as a result of previous random selection (as described above, it is possible that the current game prize status might end up as a "lose" due to the timing which the player actuates the stop buttons), it would be extremely significant to make a demonstration alerting the player to that fact. In the type of slot machines in which the prize status is determined by random selection using random numbers for each game, when the prize status resulting from random selection in the current game is a "Big Jackpot," a demonstration may be made by unusual operations, such as unusual lights or sounds.

However, in the conventional slot machines described above, the results are randomly selected using random numbers for each game, so only the current game prize status is known. Thus, demonstrations are made only when the randomly selected result of the current game is a "Big Jackpot," and there are fewer demonstrations when there are fewer "Big Jackpots. " There is thus a problem in that the demonstrations are not very effective in arousing the interest of the player to play more games.

Figure 1:
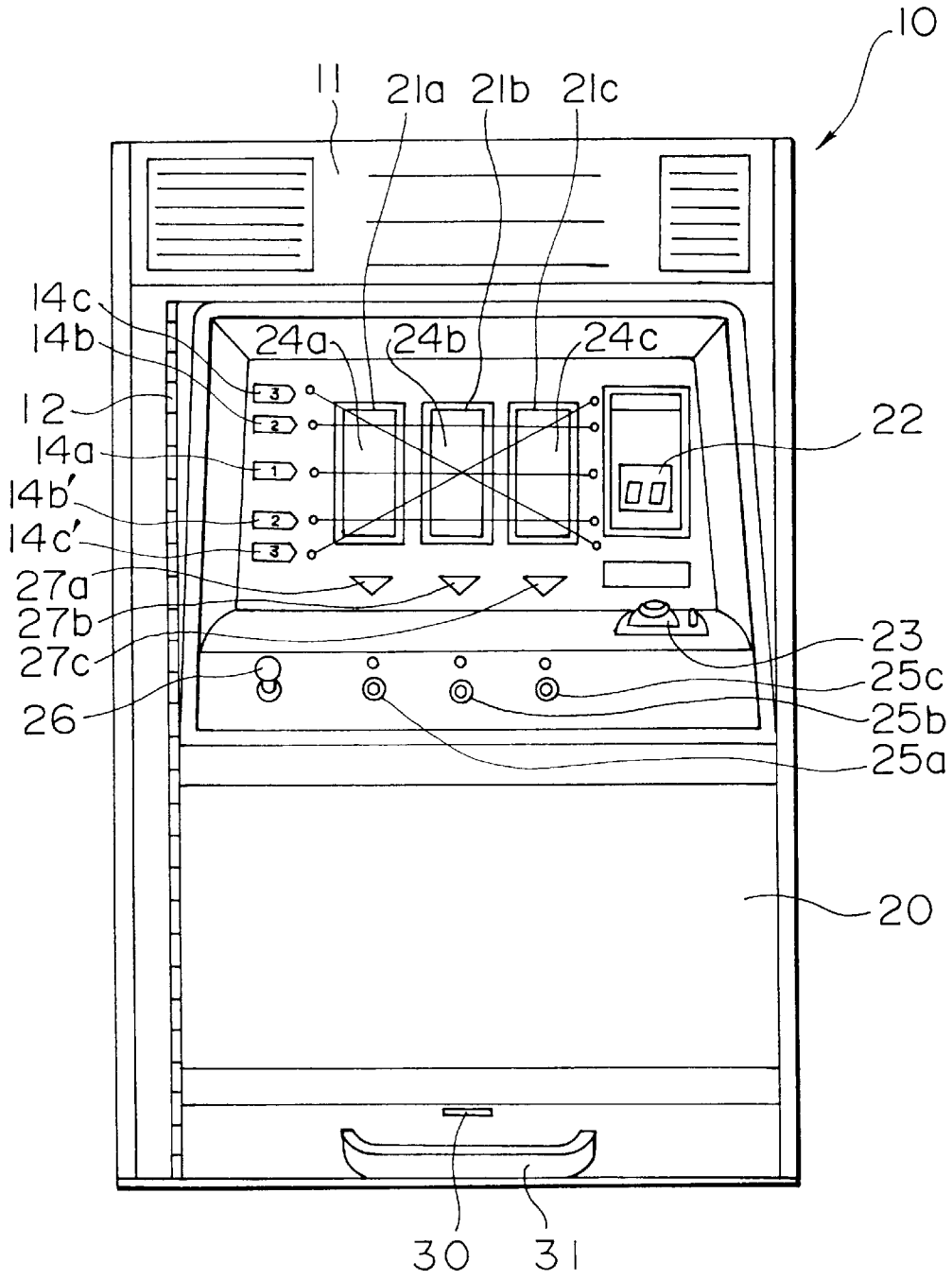
FIG. 1 illustrates a slot machine according to an embodiment of the present invention.

Referring to FIG. 1, a slot machine according to an embodiment of the present invention includes a main unit 10 having a display panel 11 for noting the combination of prize symbols, winnings, and the like. A speaker 56 and one or more lights 38 is included on the display panel 11, or may be placed elsewhere on the main unit 10. Changes in the tone, volume or nature of the sounds may be broadcast through speaker 56, or changes in the color or timing of the light 38, or some combination thereof, may be used to demonstrate the prize status, i.e., the likelihood of winning a prize, to the player. Alternatively, static or moving text, numbers, or designs could be illuminated in a portion of the display panel 11 or on the main unit to indicate to the player that there is an increased likelihood of winning a "Big Jackpot". A front door panel 20 is shown on the main unit 10. The panel 20 may be opened and closed on the main unit 10 by a set of hinges 12 to allow the contents of the main unit 10 to be inspected and repaired, to recover and replace tokens, and to perform similar functions.

One or more windows 21*a–c* (three are shown in FIG. 1) are provided on the front door panel 20 for viewing one or more reels 24*a–c* located on the main unit 10 side. A digital display 22 is provided for the sequential digital display of the number of tokens paid out for a prize or of the number of tokens paid out as tokens are paid out. A token input slot 23 is included to allow a player to insert a token before the start of the game. A plurality of stop buttons 25*a–c* are provided to allow a player, or a control device, to operate the buttons to stop the rotating reels at an arbitrary time. A start lever 26 is shown on the front, or may be placed on the side, of the main unit 10 to allow a player to start the game and rotate the reels. A set of stop lamps 27*a–c* are provided. The stop lamps 27*a–c* may be controlled so as to light up after the reels 24*a–c* have rotated a prescribed number of times by the operation of the start lever 26, and to indicate that the stop buttons 25*a–c* have been activated. A token pay outlet 30 and a receiving dish 31 are located at the bottom, or may be located on the side, of the main unit 10. A set of display lamps 14*a*, 14*b*, 14*c*, 14*b*', 14*c*', which are marked with the characters "1", "2", and "3" are shown on the front of the main unit 10.

Figure 2:
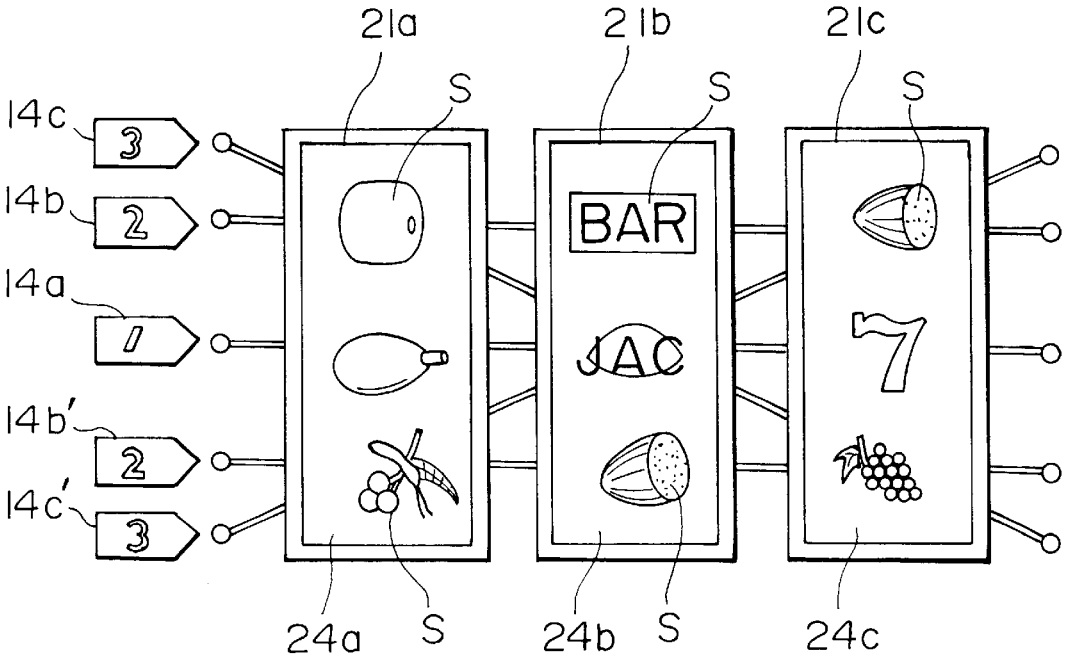
FIG. 2 illustrates the windows for viewing the reels of the slot machine depicted in FIG. 1.

FIG. 2 is a more detailed view of the window for viewing the reels 24*a–c* of the slot machine depicted in FIG. 1. In the example shown, the number of prize lines is selected according to the number of tokens entered prior to the start of the game. That is, in FIG. 2, three symbols, S, on each of the three reels 24*a–c* may be seen through each of the three windows 21*a–c*. The display lamps 14*a*, 14*b*, 14*c*, 14*b*', 14*c*' are connected so as to light up to display the lines that have been activated according to the number of tokens entered. Thus, the selection of the number of active lines is determined by the number of tokens entered prior to the operation of the start lever 26. When one token is entered, only one line, which is associated with one display lamp 14*a* and mark "1", is activated per prize determination; when two tokens are entered, a total of three lines, which are associated with three display lamps 14*a*, 14*b*, 14*b*' and the marks "1" and "2" are activated per prize determination; and when three tokens are entered, a total of five lines, which are associated with all five of the display lamps 14*a*, 14*b*, 14*c*, 14*b*', 14*c*' and with the marks "1", "2" and "3", are activated. In FIG. 2, one or more of the display lamps 14*a*, 14*b*, 14*c*, 14*b*', 14*c*' light up to display the lines that have been activated according to the number of tokens entered. The selection of the number of active lines is determined by the number of tokens entered prior to the operation of the start lever 26. This selection is done in accordance with the flowchart shown in FIG. 3.

Figure 3:
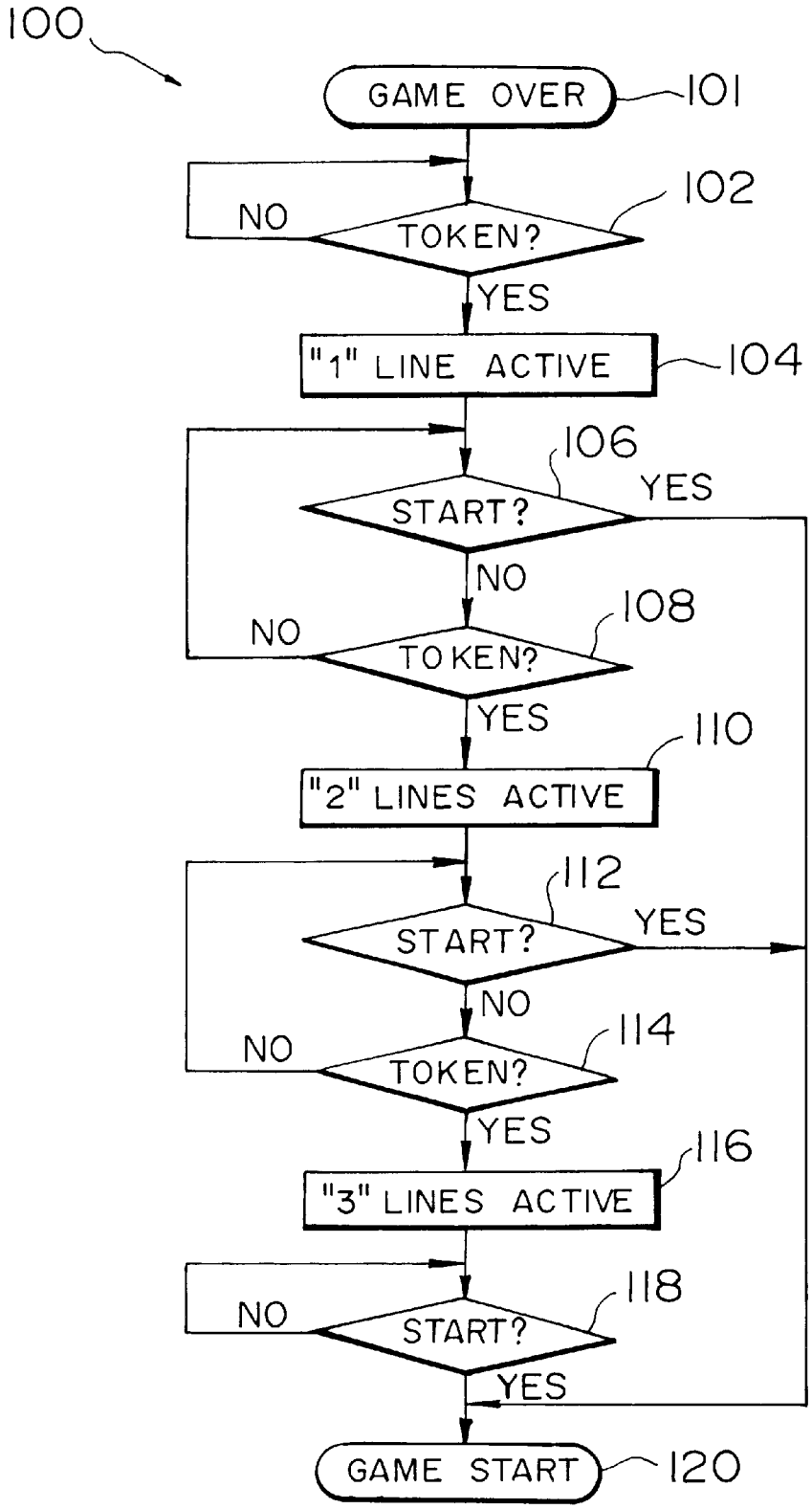
FIG. 3 is a flowchart illustrating the process for determining active prize lines.

FIG. 3 is a flowchart 100 illustrating the selection of lines to activate by lighting up one or more of the lamps 14*a*, 14*b*, 14*c*, 14*b*', 14*c*'. The selection may be made using a microswitch, a photosensor, or another similar electrical signal-based system for detection of the insertion of a token and determination as to whether or not the start lever 26 has been operated. In the flowchart 100, the line activation process starts at a step 101 indicating conclusion of a prior game. Following the step 101 is a test step 102 that determines whether a token has been entered. The test step 102 is repeated until a token is entered. Once a token has been entered, control passes to a step 104 so that a single display lamp 14*a* will be lit to activate a single line, which is marked with a "1" in FIG. 1. Following the step 104 is a test step 106 that determines whether the start lever 26 has been pulled. If the start lever 26 has been pulled, then the game proceeds to a game start step 120 and the game starts. Otherwise, a test step 108 determines whether a second token has been entered. The test steps 106, 108 are repeated until either the lever 26 is pulled or a second token is entered. If a second token is entered, control passes to a step 110 that indicates that two more lamps 14*b*, 14*b*' will be lit to activate two more lines, which are marked with a "2" in FIG. 1, for a total of three lines activated. Following the step 110, a test step 112 is performed to test whether the start lever 26 has been pulled. If the start lever 26 has been pulled, control passes from the step 112 to the game start step 120. Otherwise, a test step 114 is performed to determine whether a third token has been entered. The steps 112, 114 are repeated until either the lever 26 is pulled or a third token is entered. If a third token is entered, two more display lamps 14*c*, 14*c*', which are marked with a "3" in FIG. 1, will be lit to activate two more lines, for a total of five lines activated. A test step 118 is then performed to determine whether the start lever 26 has been pulled. If the start lever 26 has been pulled, then control passes to the game start step 120. Otherwise, the test step 118 is repeated. In the "active line" process shown in FIG. 3, one or more of the display lamps 14*a*, 14*b*, 14*c*, 14*b*', 14*c*' are turned on depending on the number of tokens entered, and, at the same time, a signal is input to the microcomputer, as described below, so that the number of token entered is taken into account during the determination of the prize.

Figure 4:
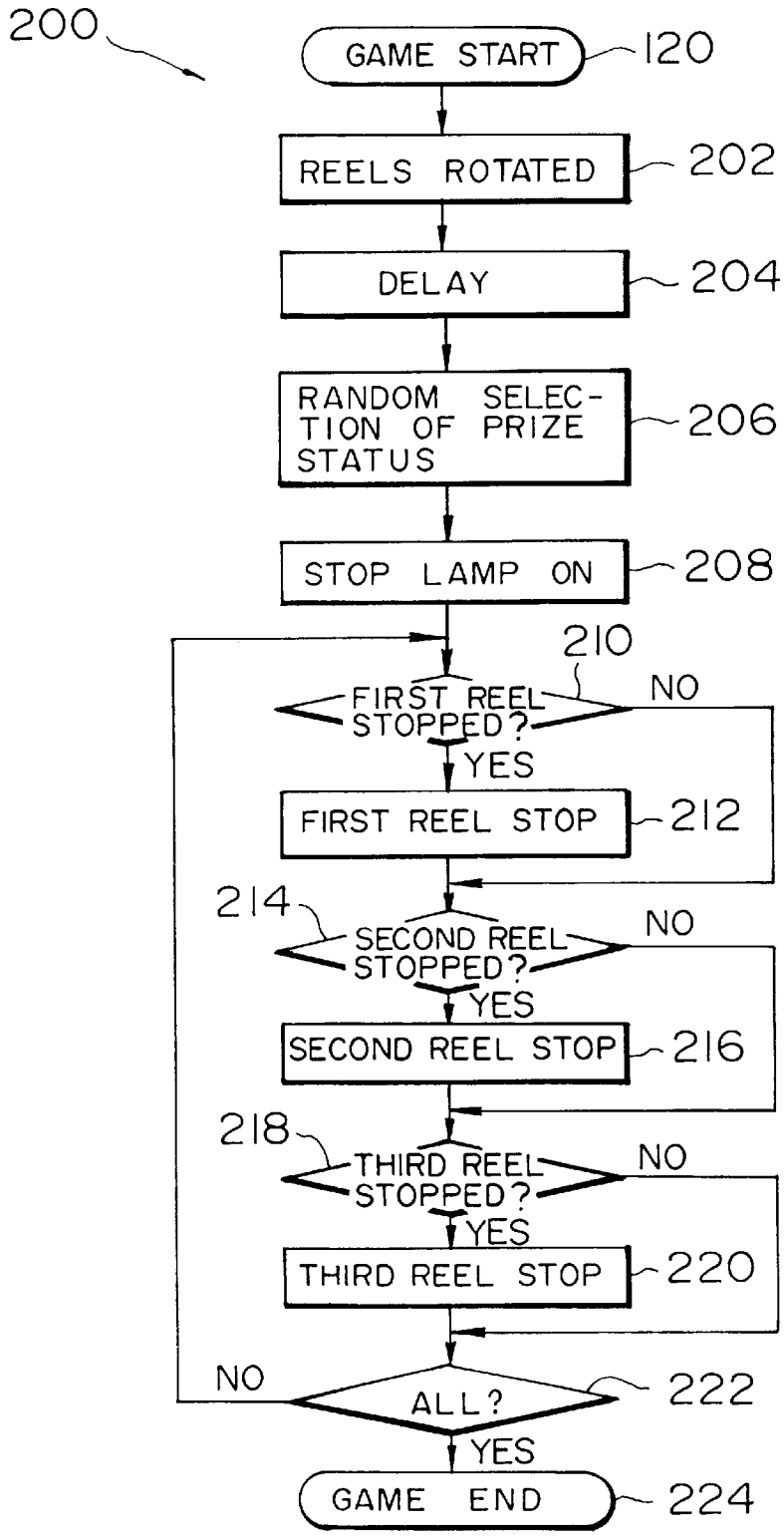
FIG. 4 is a flowchart illustrating a basic game progress.

FIG. 4 is a flowchart 200 illustrating progress of the game once the number of prize lines has been determined in accordance with the process shown in FIG. 3 (or by following one of a variety of conventional processes equivalent to that shown in FIG. 3). The game begins at the game start step 120 (of FIG. 3). A reel rotation step 202 follows the start step 120. Following the reel rotation step 202 is a delay step 204. Following the delay step 204 is a result selection step 206 in which the results for a plurality of games are randomly selected to provide a random selection of prize status. Following the result selection step 206 is a step 208 in which the stop lamp is turned on. Following the step 208 is a test step 210 in which it is determined whether the first stop button 25*a* has been pressed. If so, the first reel 24*a* is stopped at a step 212, after which control passes to a test step 214. Otherwise, control passes from the step 210 to the test step 214. The test step 214 determines whether the second stop button 25*b* has been pressed. If so, then the second reel 24*b* is stopped in a step 216, after which control passes to a test step 218. Otherwise, control passes from the step 214 to the test step 218. The test step 218 determines whether the third stop button 25*c* has been pressed. If so, control passes to a step 220 in which the third reel 24*c* is stopped, after which a test step 222 is performed. Otherwise, control passes from the step 218 to the test step 222. At the test step 222, it is determined whether all of the reels 24*a–c* have been stopped. If so, then control passes to a game end step 224. Otherwise, control returns to the test step 210 and the process is repeated.

After the number of prize lines have thus been determined, the game progresses according to the flowchart in FIG. 4. The three reels 24*a–c* rotate when the start lever 26 is operated. The prize status, as described below, is randomly selected, either immediately or after a prescribed period of time has passed. The stop buttons 25*a–c* are activated to stop the reels 24*a–c* and the stop lamps 27*a–c* light up to indicate that the reels 24*a–c* have stopped.

The reel stopping steps 210, 214, 218 in the flowchart of FIG. 4 are determined and processed depending on whether the stop buttons 25*a–c* have been operated for the rotation of the three reels 24*a–c*. When any of the three stop buttons 25*a–c* is operated and the reel corresponding to that stop button is rotating, then that reel is stopped. Accordingly, any of the three reels 24*a–c* can be stopped, for example, and the current game will be over when it is determined that all of the reels 24*a–c* have been stopped at the step 222. When the game is over, the process for determining the prize is carried out.

Figure 5:
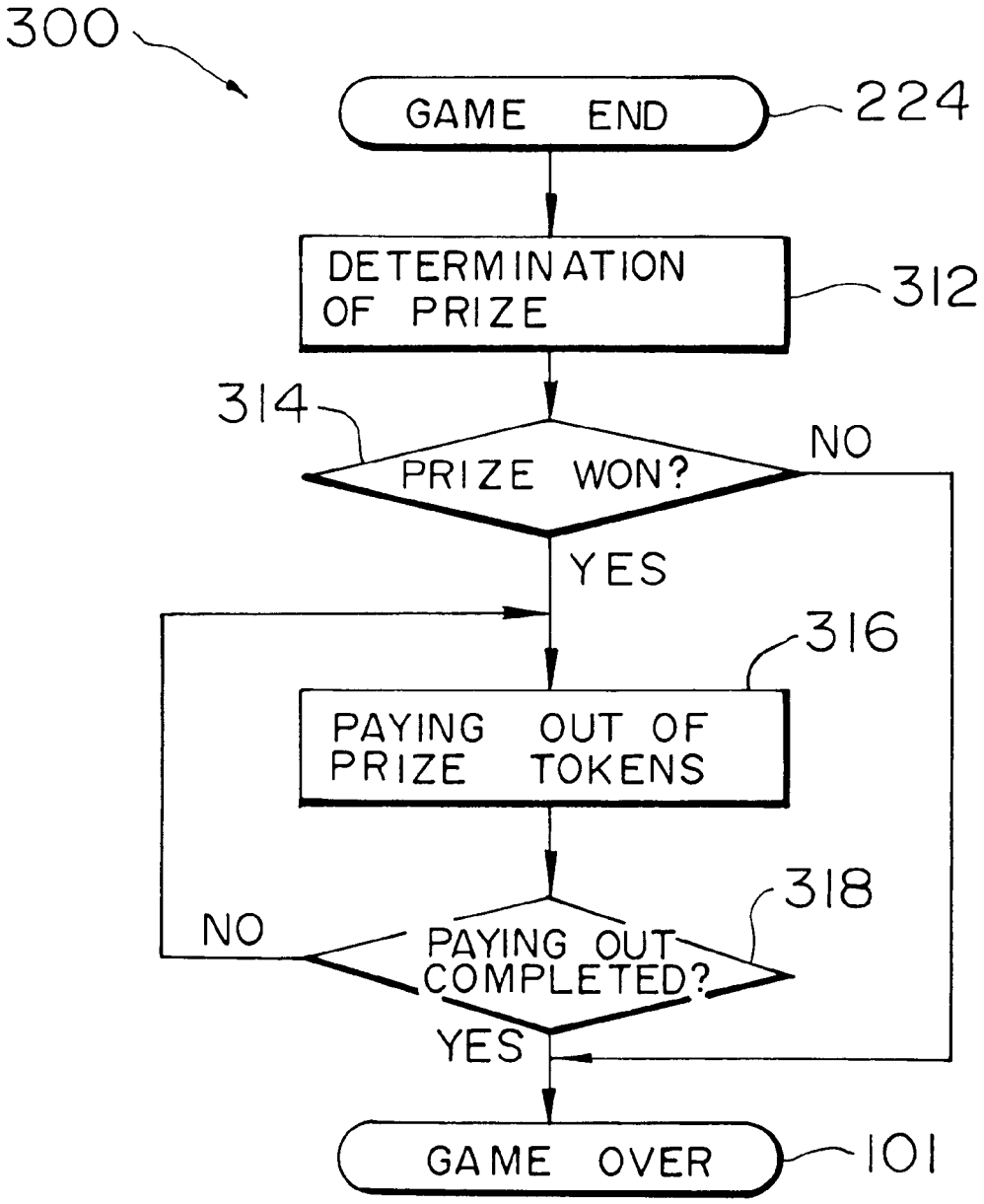
FIG. 5 is a flowchart illustrating a determination of the prize and paying out of tokens.

FIG. 5 is a flowchart 300 illustrating the determination of the prize when the game is over. Following the game end step 224 (of FIG. 4), control passes to a step 312 in which determination of the prize is made. Following the step 312 is a test step 314 which tests whether a prize was won. If so, control passes to a step 316. Otherwise, control passes to the game over step 101 (of FIG. 3). In the step 316 the prize tokens are paid out in the proper amount. Following the step 316 is a test step 318 in which it is determined whether the paying out has been completed. If so, control passes to the game over step 101. Otherwise, control returns to the step 316 and the process is repeated until the game over step 101 is reached.

The prize determination process is carried out according to conventional techniques. Tokens are paid out when a prize has been won. During the prize determination step 312, optoelectric signal components provided for the symbols on the reels 24*a–c* may be read by photosensors. Alternatively, signal components may be provided at locations on the reels 24*a–c* so that reset pulses may be obtained for each reel rotation by pulse motors that drive the reels 24*a–c*, allowing determination of whether a pulse signal has been supplied for any pulse to the pulse motor until the reels 24*a–c* have been stopped following the production of the reset pulse. In the prize determination step 312, the symbols of the reels 24*a–c* are used as code signals and the combination is matched with the ROM, as described below. When a prize has been won, a hopper motor is driven to pay out the prize tokens. The tokens that are paid out are counted, for example, by a token counter located in the token pay out route, and the game is over when the prescribed number of tokens has been reached.

Figure 6:
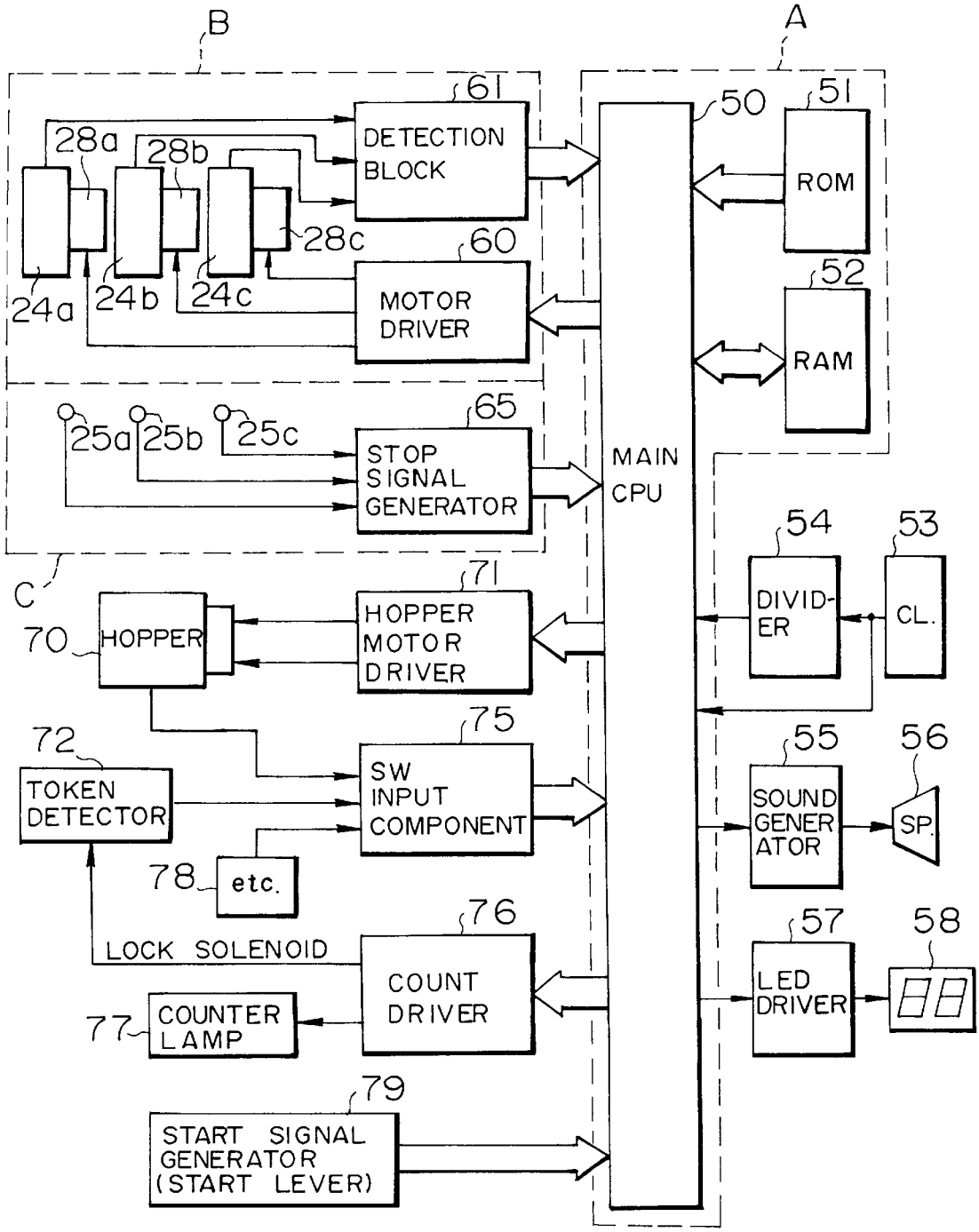
FIG. 6 is a schematic diagram of a microcomputer controlling a game machine.

FIG. 6 is a block diagram depicting the microcomputer controlling the slot machine in the present invention. In FIG. 6, a block A indicates a main control component having a main CPU 50, a ROM 51, and a RAM 52. The ROM 51 stores a correspondence table of the symbols described above and symbol codes, stores symbol codes corresponding to prizes, and stores a table of the number of prize tokens paid out, as well as prize probability tables and the like for the prize status when a prize is awarded for the game that has been run. The RAM 52 prepares random number locations for temporarily storing random number samples after the start of a game, memory for temporarily storing data such as rotating reel code numbers, symbols, and the like. A clock pulse generator 53 is included to generate a standard pulse, such as a 4 MHz pulse. The clock pulse generator 53 is coupled to a divider 54 and actuates the main CPU 50 based on the standard pulse. A divider 54 also is included. The divider 54 gives an interruption pulse of 500 Hz, for example, to the main CPU 50 to interrupt the execution process of a program. A sound generator 55 also is shown. The sound generator 55 is driven to produce sounds by means of a speaker 56 to enhance game interest at prescribed periods after the start of the game. The sound generator 55 may also be used as a demonstration means, as described below. An LED drive component 57 that drives a display such as a seven-segment digital display light-emitting diode 58, for example, also may be included. The LED drive component 57 may be used to display the number of tokens paid out or the like.

Another block B in FIG. 6 is used to show a reel drive. The three reels 24*a–c* are driven by three pulse motors 28*a–c*. The motors 28*a–c* rotate with drive pulses from a motor drive component 60. For example, the reels 24*a–c* may be rotated so that, for each pulse, one symbol per reel is visible on each of the reels 24*a–c* from the windows 21*a–c*. The reels 24*a–c* may be constructed so as to produce a reset signal for each rotation. The reset signals may be detected by a detection block 61. In the main CPU 50, the reset signals from the detection block 61 and the number of drive pulses given to the motor may then be compared, so that the type of reel symbol visible in the windows 21*a–c* may be specified.

Another block C in FIG. 6 is used to show components for providing a stop operation, including a stop signal generator 65 that detects the pressing of the stop buttons 25*a–c* provided for the reels 24*a–c*. A prize token pay out hopper 70 and a hopper motor drive component 71 also are shown in FIG. 6. A token detector 72 that detects the insertion of tokens prior to the start of the game also is shown. The signal for the number of tokens paid out from the hopper 70 and the signal for the number of tokens entered from the token detector 72 are sent via a switch input component 75, the main CPU 50 and a count drive component 76 to a counter or lamp 77, and the number of tokens entered or paid out is detected, or the display lamps 14*a*, 14*b*, 14*c*, 14*b*', 14*c*', for the active prize lines are lit up according to the number of tokens entered. The lamp 77 also can be used as a demonstration means, as described below. When three tokens are entered by a player, a lock solenoid 73 is driven to lock the entered tokens. Another switch operating component 78, such as a stop switch or the like, is operated when a player wishes to stop a game after a token has been entered. A start signal generator 79 is shown and may be constructed, for example, using the start lever 26.

The system described above allows the determination process of the game to be carried out by a program executing on the main CPU 50. The method for randomly selecting the prize status and the method for determining whether or not a demonstration is to be made, which are features of this alternative embodiment, are described below. The prize status may be randomly selected as a result of a match between the random number values sampled at the start of the game, as described above, and the groups of numerical values for awarding a prize which are stored in the prize table in the ROM 51.

Figure 7:
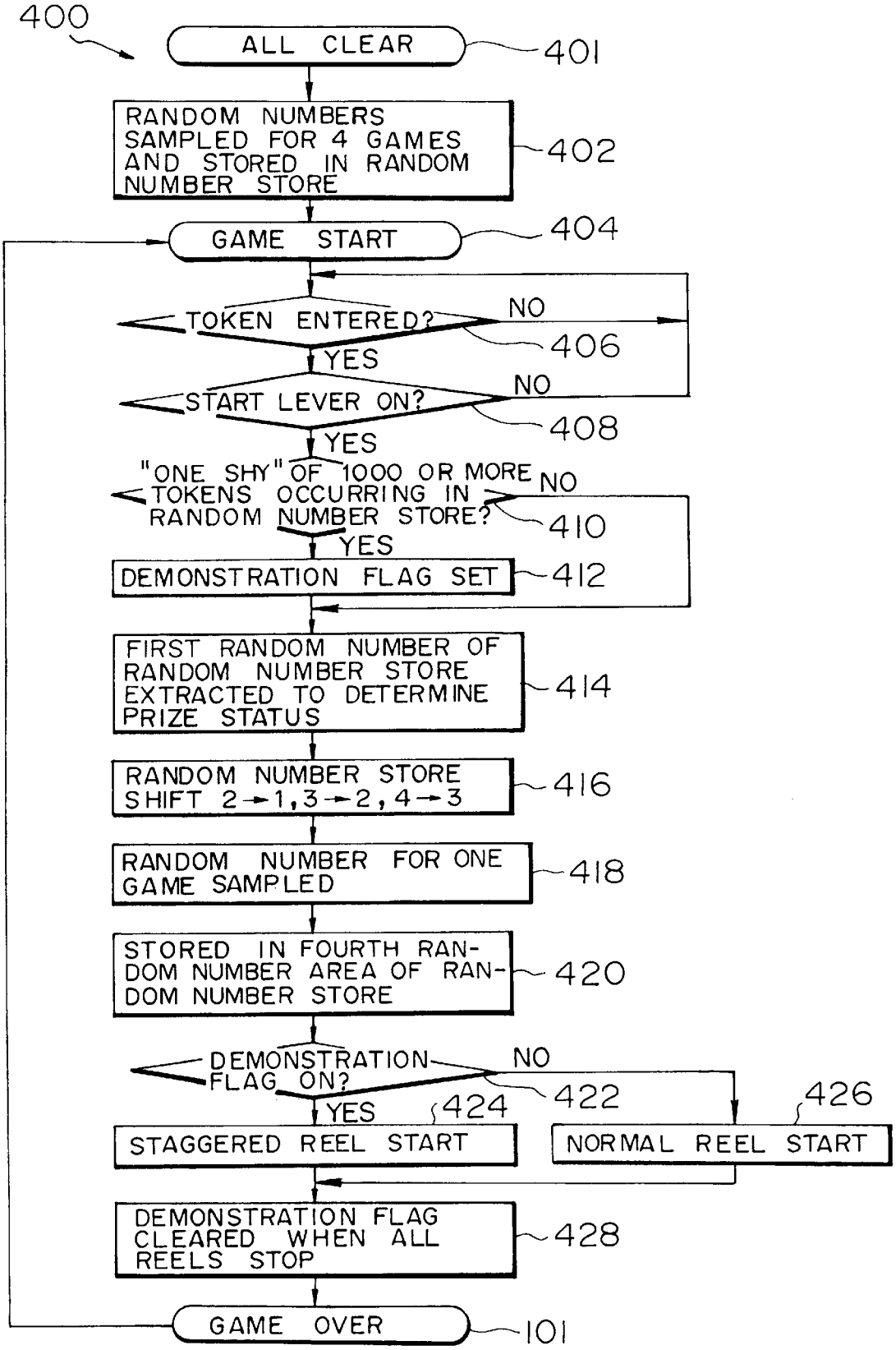
FIG. 7 is a flowchart illustrating the operation of a game machine.
Figure 8:
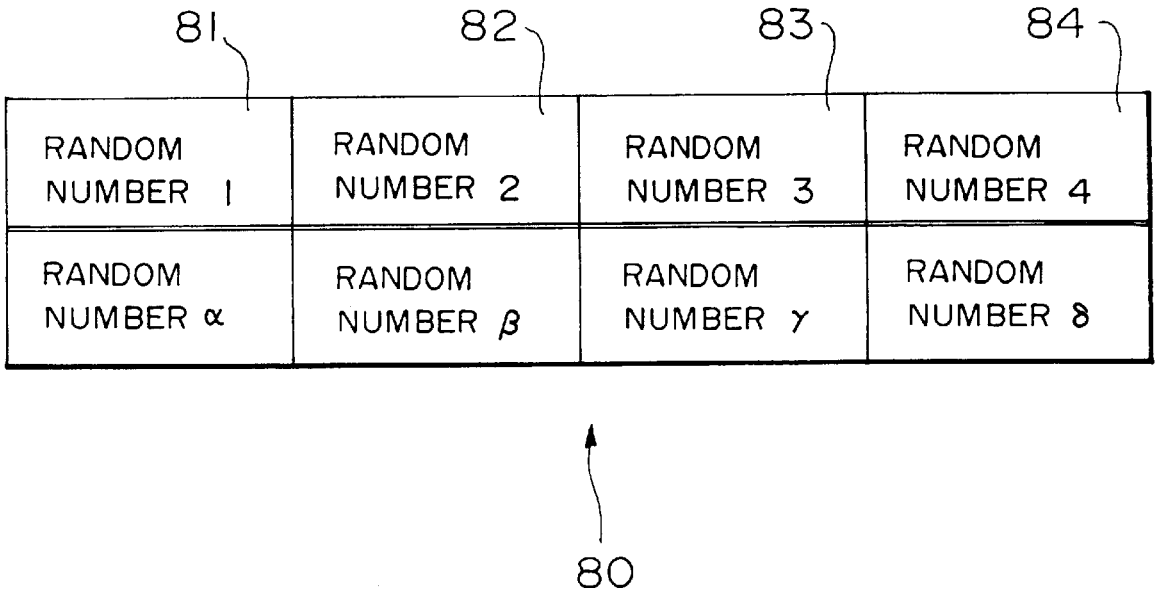
FIG. 8 is a schematic illustration of the structure of a random number store in a game machine.

FIG. 7 is a flowchart 400 describing one possible method of operation of the slot machine in an embodiment of the present invention and FIG. 8 is an illustration of the structure. Turning first to FIG. 7, the operation process begins at an all clear step 401. Following the step 401 is a step 402 in which random numbers are sampled for four games and stored in a random number store (shown in FIG. 8 and described below). Following the step 402 is a game start step 404 in which the game starts. Following the step 404 is a test step 406 in which a test is made to determine whether a token has been entered. If so, control passes to a test step 408. Otherwise, the test step 406 is repeated. In the test step 408, it is determined whether the start lever 26 is on. If so, control passes to a test step 410. The test steps 406, 408 are repeated until either the start lever 26 is on or a token is entered. In the test step 410, a determination is made whether there is a "One Shy" (described below) of 1000 or more tokens occurring in the random number store. If so, control passes to a step 412 in which a demonstration flag is set, and, following the step 412, control passes to a step 414. Otherwise, control passes from the step 410 to the step 414 and thus the demonstration flag is not set. In the step 414, a first random number is extracted from the random number store to determine the prize status. Following the step 414 is a step 416 in which the random numbers in the random number store are shifted, as described below. Following the step 416 is a step 418 in which a random number for one game is sampled. Following the step 418 is a step 420 in which the random number sampled in the step 418 is stored in the fourth random storage number area of the random number store. Following the step 420 is a test step 422 in which it is determined whether the demonstration flag is ON. If so, control passes to a step 424 in which reel rotation starts in a staggered manner. Otherwise, control passes to a step 426 in which reel rotation starts in a normal manner. Following each of the steps 424, 426 is a step 428, in which the demonstration flag is cleared when all reels stop rotating. Following the step 428, control passes to the game over step 101.

FIG. 8 illustrates a possible structure of the random number store 80. When, for example, the main power source switch (not shown) of the slot machine is turned on, or when a clear switch (not shown) is switched on, the entire system is initialized. Upon initialization, the random numbers stored in the random number store 80 shown in FIG. 8 are cleared, and the demonstration flag is cleared in the all clear step 401.

As shown in FIG. 8, the random number store 80 has four areas: a first random number area 81, a second random number area 82, a third random number area 83, and a fourth random number area 84, in which four random numbers α, β, γ, δ can be stored. The first random number α stored in the first random number area 81 is used in the random selection of the current game prize status, the second random number β stored in random number area 82 is used in the random selection of the prize status in the game following the current game, the third random number γ stored in random number area 83 is used in the random selection of the prize status of the second game following the current game, and the fourth random number δ stored in the fourth random number area 84 is used in the random selection of the prize status in the third game following the current game. That is, random numbers are stored to be used for the next three games following the current game as well as for the current game, i.e., up through the next three games from the current game. In the present embodiment, it is possible to determine the prize status, and therefore the stopping position of all of the reels 24*a–c,* using one random number. However, the present invention is not limited to this, and a random number may be provided for each of the reels 24*a–c,* or for a subset of the reels 24*a–c.*

To return to the flowchart 400 of FIG. 7, in the all clear step 401, the entire system is initialized and the random numbers stored in the random number store 80 are cleared. Following the all clear step 401 is the step 402 in which random numbers for four games (a total of four random numbers) are sampled and the sampled random numbers are stored in the first, second, third and fourth areas 81–84 in the random number store 80. Following the step 402 is the game start step 404, where the main unit 10 of the slot machine is placed in game start mode. In the step 406, it is determined whether a token has been inserted. In the step 408, which occurs after a token has been inserted, it is determined whether the start lever 26 has been actuated.

When the start lever 26 is on, it is determined at the test step 410 whether any of the four random numbers in the random number store 80 correspond to a "Big Jackpot," that is, a prize paying out 1000 or more tokens, or a state in which there is no "Big Jackpot" because the symbol on one of the reels 24*a–c* (three reels in the present embodiment) does not match (here, the state of two matches is called "One Shy"). (If four or more reels were used and all but two reels matched, then the state could be called "Two Shy", and so on, depending on the number of reels used. The condition of having all but a predetermined number of reels, or dice, or other similar type of game feature, match or correspond is referred to herein as a pseudo specific game result condition.) When there is no "One Shy" random number, the game proceeds to the step 414. When there is a "One Shy" random number, a demonstration flag is set up in the step 412. Alternatively, a different type of demonstration could be made depending on whether a "One Shy", "Two Shy", "Big Jackpot", "Little Jackpot", or some combination or variation thereof, was present in one or more of the areas in the random number store 80.

In the step 414, a random number is taken from the first random number area 81 in the random number store 80. The random number thus taken is used for random selection of the current game prize status, and the current game prize status is determined. In the step 416, the random number stored in the second random number area 82 is then moved to the first random number area 81, the random number stored in the third random number area 83 is moved to the second random number area 82, and the random number stored in the fourth random number area 84 is moved to the third random number area 83. In the step 418, a new random number to be stored in the fourth random number area 84 is then sampled. In the step 420, the new random number is stored in the fourth random number area 84.

In the step 422, the system checks to see whether or not the demonstration flag is ON, i.e., is set. When the demonstration flag is not ON, the reels begin to rotate together as usual in the step 426. When the demonstration flag is ON, the reels start rotating in a staggered manner (for example, the first reel 24*a* is rotated, and a little while later the second and third reels 24*b*, 24*c* are rotated) in the step 424. A demonstration may be made shortly after the reels begin to rotate. That is, a player may know there is no probability of a "Big Jackpot" when the reels start to rotate simultaneously, whereas a player may know that there is a probability of a "Big Jackpot" when the reels start rotating in a staggered manner, thereby giving the player greater hope. When all the reels are stopped, the demonstration flag is cleared in a clearing step 428, and the game is over. The system subsequently returns to the game start step 404 at the start of the game, and the next game is begun.

In the present embodiment, random numbers for the current game through the next three games have been previously sampled and are used to determine whether or not a demonstration is to be made in the current game, so there is a greater number of games with demonstrations than in existing games, making it possible to provide effective demonstrations arousing the interest of the player.

A demonstration may be made even when there is no "Big Jackpot" if the symbol on one of the reels does not match those on the other reels, i.e., a "One Shy" condition is present, or, alternatively, if the symbols on two of four or more reels do not match those on the other reels, i.e., a "Two Shy" condition is present, thus increasing the number of games with demonstrations and making it possible to provide effective demonstrations arousing the interest of the player.

In the present embodiment, a plurality of random numbers may be stored in the random number store 80 for use in the next three games, but the present invention is not limited to this situation, and a plurality of random numbers to be used in more or less than the next three games can also be stored in the random number store 80.

An additional alternative embodiment of a slot machine featuring the application of the present invention is described below. The appearance and basic operation of the slot machine in this alternative embodiment are similar to those of the embodiment described above, so FIGS. 1 through 6 are also applicable to this alternative embodiment and will not be repeated. The method for randomly selecting the prize status and the method for determining whether or not a demonstration is to be made, which are features of the alternative embodiment, will be described first. For example, the prize status may be randomly selected as result of a match between the random number values sampled at the start of the game and the groups of numerical values for awarding a prize that are stored in the prize table in the ROM 51.

Figure 9:
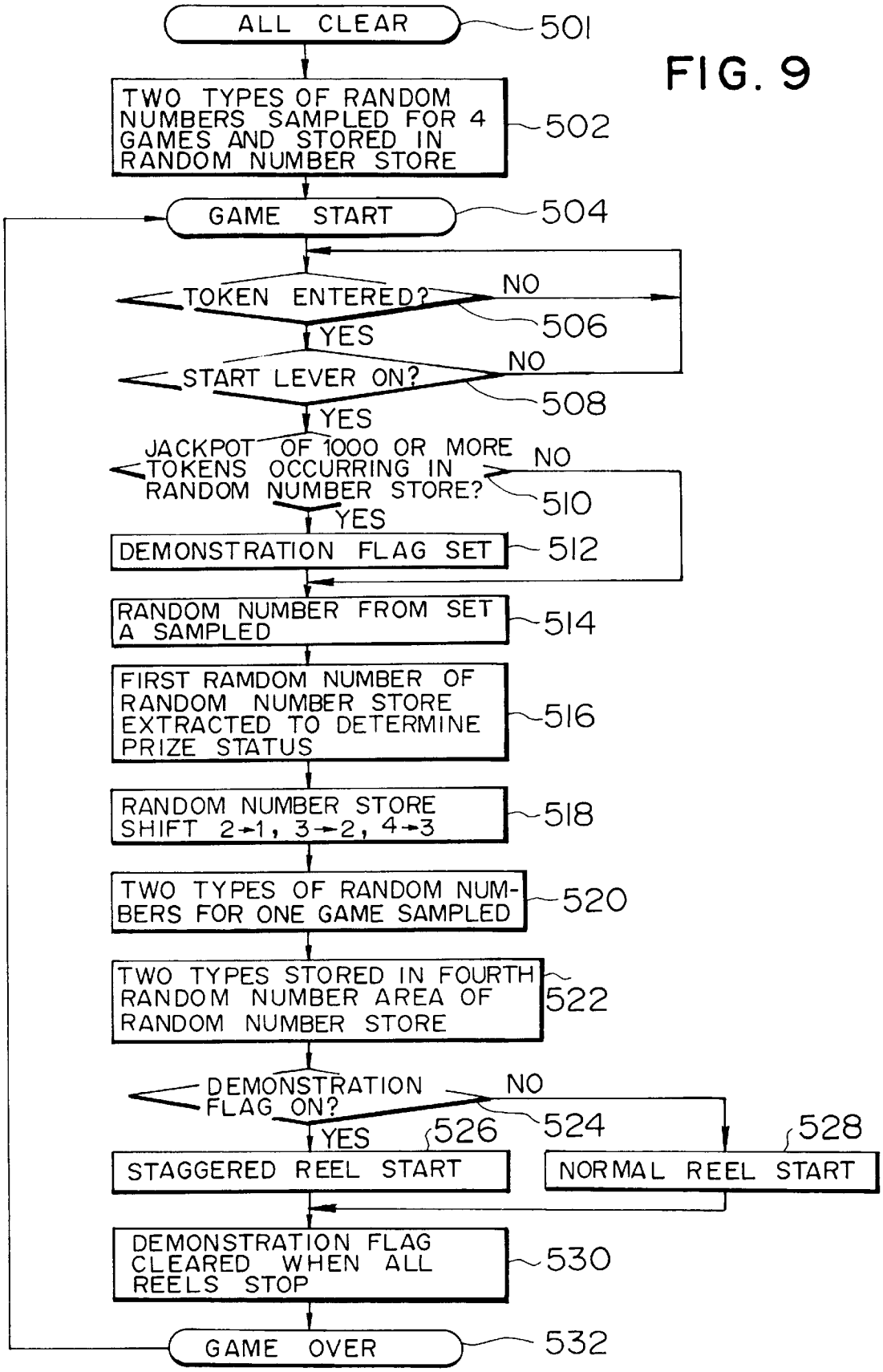
FIG. 9 is a flowchart illustrating operation of a game machine according to another embodiment of the present invention.

FIG. 9 is a flowchart 500 illustrating operation of the slot machine in the additional alternative embodiment. The process begins with an all clear step 501. Following the step 501 is a step 502 in which two types of random numbers are sampled for four games and are stored in the random number store. Following the step 502 is a game start step 504 in which the game is started. Following the step 504 is a test step 506 in which it is determined whether a token has been entered. If so, control passes to a test step 508. Otherwise, the test step 506 is repeated until a token is entered.

In the test step 508, it is determined whether the start lever is ON. If so, control passes to a test step 510. Otherwise, the test steps 506, 508 are repeated until either a token is entered or the start lever 26 is ON. In the test step 510, it is determined whether a jackpot of 1000 or more tokens occurs in the random number store. If so, control passes to a step 512 in which a demonstration flag is set. Otherwise, control passes from the step 510 to a step 514. In the step 514, a random number from a category A (described below) is sampled. Following the step 514 is a step 516 in which a random number from the first random number area of the random number store is extracted to determine the prize status for the current game. Following the step 516 is a step 518 in which there is a shift of the numbers in the random number store (as described below). Following the step 518 is a step 520 in which two types of random numbers are sampled for one game. Following the step 520 is a step 522 in which the two types of random numbers sampled in the step 520 are stored in the fourth random number storage area in the random number store. Following the step 522 is a test step 524 in which it is determined whether the demonstration flag is ON. If so, control passes to a step 526 in which a staggered reel start is made. Otherwise, control passes from the step 524 to a step 528 in which a normal reel start is made. Following the step 526 or the step 528 is a step 530. In the step 530, the demonstration flag is cleared when all reels stop. Following the step 530 is a game over step 532. Following the game over step 532, control returns to the game start step 504.

FIG. 10 illustrates structure of the random number store in the additional alternative embodiment. When, for example, the main power source switch of the slot machine is turned on, or when a clear switch (not shown) is switched on, the entire system is initialized. Upon initialization, the random numbers stored in the random number store 81 shown in FIG. 10 are cleared, and the demonstration flag described below is cleared at the all clear step 501.

As shown in FIG. 10, the random number store 90 has four areas: a first random number area 91, a second random number area 92, a third random number area 93, and a fourth random number area 94, in each of which are provided two types of sub-areas for a first and a second random number. The random number store 90 can thus store eight random numbers $\alpha_1$, $\alpha_2$, $\beta_1$, $\beta_2$, $\gamma_1$, $\gamma_2$, $\delta_1$, $\delta_2$, which are referred to herein as random number set B.

Either of the two random numbers (first and second random numbers) stored in the two sub-areas of random number area 91 may be used in the random selection of the current game prize status, either of the two random numbers stored in the two sub-areas of the second random number area 92 may be used in the random selection of the prize status in the game following the current game, either of the two random numbers stored in the two sub-areas of the third random number area 93 may be used in the random selection of the prize status of the second game following the current game, and either of the two random numbers stored in the two sub-areas of the fourth random number area 94 may be used in the random selection of the prize status in the third game following the current game. That is, random numbers may be stored for use in the next three games following the current game as well as in the current game, i.e., to be used up through the next three games following the current game, (or another alternative embodiment, in more or less than the next three games following the current game).

A set of one or more separate random numbers, which are referred to herein as random number set A, that are not stored in the random number store 90 also may be provided. In an embodiment described herein, these separate random numbers in random number set A may be obtained by the random generation of two one-bit types of numbers such as zero and one. The random number used in the current game may be selected from between the two random numbers stored in the first random number area 91 of the random number store 90, depending on whether the corresponding separate random number A is zero or one.

The prize status, that is, the position where the reels 24*a–c* stop, may be determined with a single random number or random numbers may be provided for each of the reels 24*a–c*.

To return to the description in FIG. 9, in the step 502, random numbers for four games (a total of eight random numbers) are sampled, the sampled random numbers are stored in the first through fourth random number areas 91–94 in the random number store 90, and the slot machine is placed in game start mode in the game start step 504. Whether or not a token has been inserted is then detected in the step 506, and after a token has been inserted, whether or not the start lever 26 has been pulled on is then detected in the step 508.

When the start lever 26 has been pulled, the system checks in the step 510 to see whether any of the eight random numbers in the random number store 90 correspond to a "Big Jackpot" state, that is, a prize paying out 1000 or more tokens. When there is no "Big Jackpot" random number, the game proceeds in the step 514, and when there is a "Big Jackpot" random number, a demonstration flag is set in the step 512.

In the step 514, the random numbers A described above are sampled, and based on the value of the random number A, the random number used in the current game is determined from among the two random numbers (random numbers $\alpha_1$, and $\alpha_2$) in the first random number area 91 of the random number store 90. The random number thus determined is randomly selected from the random number store 90 and is used for the random selection of the prize status of the current game to determine the prize status of the current game in the step 516. The two random numbers stored in the second random number area 92 of the random number store 90 are then moved to the first random number area 91, the two random numbers stored in the third random number area 93 are moved to the second random number area 92, and the two random numbers stored in the fourth random number area 94 are moved to the third random number area 93 in the step 518. Two new random numbers to be stored in the fourth random number area 94 of the random number store 90 are then sampled in the step 520 and then stored in the fourth random number area 94 in the step 522.

At the step 524, the system checks to see whether or not the demonstration flag is ON, namely, is set. When the demonstration flag is not ON, the reels begin to rotate together as usual in the step 528. When the demonstration flag is ON, the reels start rotating in a staggered manner (for example, the first reel 24*a* is rotated, and a little while later the other two reels 24*b*, 24*c* are rotated) in the step 526. In the present embodiment, a demonstration may be made shortly after the reels 24*a–c* begin to rotate. That is, the player knows there is no probability of a "Big Jackpot" when the reels start to rotate simultaneously, whereas the knowledge that there is a probability of a "Big Jackpot" when the reels start rotating while staggered gives the player greater hope. However, whether the random number for the "Big Jackpot" is actually used is determined after the demonstration flag has been set to ON. Therefore, there is a demonstration, and the reels are sometimes staggered as a result, bolstering the player's anticipation and arousing further interest. When all the reels are stopped, the demonstration flag is cleared at the step 530, and the game is over. The system subsequently returns to the game start step 504, and the next game may be started.

In an embodiment disclosed herein, random numbers for the current game through the next three games have been previously sampled and are used to determine whether or not a demonstration is to be made in the current game, so there is a greater number of games with demonstrations than in the past, making it possible to provide effective demonstrations arousing the interest of the player.

In an embodiment disclosed herein, random numbers used in the current game are selected from two types of numbers (first and second random numbers), and a total of eight random numbers are used as a basis for determining whether or not a demonstration is to be made, thus increasing the number of games with demonstrations and making it possible to provide effective demonstrations arousing the interest of the player.

In an embodiment disclosed herein, a plurality of random numbers to be used in the next three games can be stored in the random number store 90, but the present invention is not limited to this, and a plurality of random numbers to be used in the next several games can also be stored in the random number store 90.

In an embodiment disclosed herein, a set of random numbers A allowing two types of random numbers to be taken are provided, and two random numbers used per game are stored at approximately the same time or simultaneously in the random number store 90, but the present invention is not limited to this, the set of random numbers A may allow several random numbers to be taken, of more than one-bit if desired, and several random numbers used per game may be stored in groups in the random number store 90.

The demonstration means in an embodiment disclosed herein relates to the divergence between the reels 24*a–c,* but the present invention is not limited to this and may also be constructed so as to appeal to the overall senses of the player by flashing the display lamps of the prize line or changing the sound from a sound generator in volume or tone.

As described above, the embodiments disclosed herein generally relate to slot machines, but the present invention is not limited to slot machines, and may be used for any game machine in which game results can be randomly selected.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A game machine, comprising:

random selection means for randomly selecting, at the beginning of the game, game results conditions for a current game and a predetermined number of subsequent games among a plurality of given game result conditions;

storage means for storing said game result conditions selected from the current game and the predetermined number of subsequent games;

actuating means for actuating the start of the game;

determination means for determining whether or not the game results conditions randomly selected for the current game and the predetermined number of subsequent games include a specific game result condition; and demonstration means for indicating a higher probability of winning a prize when said randomly selected game result conditions include said given game result condition for the current game and the predetermined number of subsequent games stored in said storage means.

2. A game machine according to claim 1, wherein said plurality of given game result conditions include a pseudo specific game result condition which is similar to said given specific game result condition and said demonstration means functions to make demonstration for the current game in case said pseudo specific game result condition is selected.

3. A game machine according to claim 1, further comprising a second random selection means for randomly selecting in advance several kinds of game result conditions for the current game at the beginning thereof, and selecting one of said several kinds of already selected game result conditions by a predetermined way to be a real game result condition for the current game, and wherein said demonstration means functions to make demonstration for the current game in case said several kinds of randomly selected game result conditions include said given specific game result condition.

4. A game machine, comprising:

result selection means for randomly selecting game result conditions for a current game and at least one subsequent game;

storage means for storing said game result conditions for a current game and at least one subsequent game;

determining means for determining whether the results selected by said result selection means include at least one predetermined game result; and demonstration means, responsive to said determining means for indicating a higher probability of winning a prize based on the results selected by said result selection means for the current game and the at least one subsequent game stored in said storage means.

5. A game machine, according to claim 4, further comprising:

a lever; and a plurality of reels actuated by said lever, wherein a stopping position of said reels varies according to said result selection means.

6. A game machine, according to claim 4, wherein said predetermined game result is a condition in which each of a plurality of reels is aligned with each of the other reels.

7. A game machine according to claim 4, wherein said result selection means selects a plurality of sets of randomly selected games results for the current game and at least one subsequent game; and then selects one result from the sets of randomly selected games results as a result for the current game.

8. A game machine, comprising:

a main unit;

an actuator coupled to said main unit;

a result selector coupled to said main unit and having a random result selection component which selects random results for a current game and at least one subsequent game, and a plurality of game result storage areas which store the random results;

a demonstrator indicator coupled to said main unit; and an activator coupled to said demonstrator and responsive to said result selector, whereby said activator activates said demonstrator when at least one of said game result storage areas contains a predetermined game result for the current game and the at least one subsequent game stored in said game results storage areas.

9. A game machine according to claim 8, wherein said demonstrator includes at least one light.

10. A game machine according to claim 8, wherein said demonstrator includes at least one speaker.

11. A method of playing a game, comprising:

randomly selecting game results for a current game and at least one subsequent game;

storing, in a storage area, the game results for a curtrent game and at least one subsequent game; and demonstrating when the randomly selected game results include at least one predetermined game result for the current game and the at least one subsequent game stored in said storage area.

12. A method according to claim 11, further comprising: storing the randomly selected game result conditions before demonstrating.

13. A method according to claim 12, further comprising: starting the game after storing the randomly selected game result conditions.

14. A method according to claim 12, further comprising: starting the game before storing the randomly selected game result conditions.

15. A method according to claim 12, wherein randomly selecting game results for a current game and at least one subsequent game includes selecting a plurality of sets of randomly selected game results and selecting a game result for the current game from the plurality of sets.

16. A method according to claim 12, wherein randomly selecting game result conditions for a current game and at least one subsequent game includes selecting a plurality of sets of randomly selected game result conditions and randomly selecting a game result for the current game from the plurality of sets.

17. A method, according to claim 12, wherein demonstrating includes activating at least one light.

18. A method, according to claim 12, wherein demonstrating includes controlling at least one sound.

19. A method according to claim 12, further comprising: starting the game by placing at least one token in at least one slot.

20. A method according to claim 12, wherein demonstrating includes indicating when the randomly selected game results include at least two predetermined game results.

* * * * *